US007422618B2

(12) United States Patent
Cho

(10) Patent No.: US 7,422,618 B2
(45) Date of Patent: Sep. 9, 2008

(54) EXPANSIVE CELL COMPOSITION FOR ELECTRIC ROCK DESTRUCTION

(75) Inventor: Yong-So Cho, Namyangju-si (KR)

(73) Assignee: Swell Tech Co., Ltd., Seoul (KR)

( * ) Notice: Subject to any disclaimer, the term of this patent is extended or adjusted under 35 U.S.C. 154(b) by 467 days.

(21) Appl. No.: 11/036,038

(22) Filed: Jan. 18, 2005

(65) Prior Publication Data

US 2006/0123948 A1 Jun. 15, 2006

(30) Foreign Application Priority Data

Nov. 15, 2004 (KR) ..... 10-2004-0092921

(51) Int. Cl.
*B22F 1/00* (2006.01)
*C06B 33/00* (2006.01)

(52) U.S. Cl. ..... 75/252; 149/37; 149/44

(58) Field of Classification Search ..... 75/252; 149/37, 44

See application file for complete search history.

(56) References Cited

U.S. PATENT DOCUMENTS 3,457,126 A * 7/1969 Travers et al. ..... 149/2
3,793,099 A * 2/1974 Duerksen et al. ..... 149/19.4
4,207,126 A * 6/1980 Ekman ..... 149/109.6
5,608,185 A * 3/1997 Granholm et al. ..... 149/108.4
2003/0084753 A1* 5/2003 Kim ..... 75/252

* cited by examiner

*Primary Examiner*—Roy King
*Assistant Examiner*—Ngoclan T Mai
(74) *Attorney, Agent, or Firm*—Birch, Stewart, Kolasch & Birch, LLP

(57) ABSTRACT

The present invention relates to an expansive cell composition for an electric rock destruction. The expansive cell composition is fabricated using metallic salt that is oxidation agent, metallic powder, and hydrocarbon compound. The composition is uniformly mixed at a certain composition ratio so that the composition is stably expanded by a high temperature heat and impact wave energy generated when a high current is fast discharged with respect to a metallic wire. A hybrid-oxidation and combustion reaction is obtained, in which a hybrid-oxidation and combustion reaction is performed, in which a flame oxidation reaction of metallic salt and metallic powder and a combustion oxidation reaction of a hydrocarbon compound by the flame oxidation reaction are mixed. The rocks are destructed by generating a vapor expansion force matching with a fracture ability class of rocks. Low noise and vibration are obtained when destructing rocks, and broken pieces of rocks do not fly away. Any change in quality does not occur in the composition according to the present invention.

16 Claims, No Drawings

EXPANSIVE CELL COMPOSITION FOR ELECTRIC ROCK DESTRUCTION

BACKGROUND OF THE INVENTION

1. Field of the Invention

The present invention relates to an expansive composition for an electric rock destruction, and in particular to an expansive cell composition for an electric rock destruction capable of enhancing a destructing force against rocks based on a stable expansion by a high temperature and impact wave energy generated in such a manner that a compound such as metallic salt and metallic powder that are source of oxygen instantly discharges a high current with respect to a metallic wire.

2. Description of the Background Art

Generally, in a chemical and explosive used for rock destruction in a civil construction, a compound therein is designed to chemically react by a small heat impact. At the time when a chemical reaction occurs, a large scale of gas expansion occurs for thereby destructing an object.

However, the above chemical and explosive are very unstable, so that they may be exploded by a very small impact and friction and furthermore an instant expansion reaction may be easily performed by heat. Therefore, when handling an instant expansion material such as explosive or chemicals, a very careful attention is needed. In the industry, a certain controllable explosive material has been urgently needed so that it is very stable for storage, and a desired large expansive force or a desired expansive force is obtained for explosion.

As the above explosive material, according to the Korean patent registration No. 213,577, an instant expansion metallic compound is developed. This compound is fabricated in such a manner that a metallic nitrate, a metallic powder capable of increasing a volume wherein it is oxidized by the metallic nitrate and is heated, and a reaction accelerator capable of accelerating an oxidation reaction of a metallic powder with the metallic nitrate. The above patent has advantages that a noise is small, and broken pieces do not fly away. However, in the above patent, the fabricated expansion agent is very weak to moisture, so that it is easily changed in quality. Since the reaction does not occur well after the change in quality, it is needed to supply a higher voltage using a power supply unit. In addition, an intensive electricity control technique is needed due to difficult handling, and there are always possible dangers. In view of the effects of rock destruction, workability and economic advantages are very low. In order to overcome the above problems, according to the Korean patent laid-open No. 2003-6083, an instant expansion material formed of a compound of a non-nitric acid metallic salt and metallic powder is developed. It is possible to significantly decrease noise, vibration and fly of broken pieces by decreasing the expanding force. In addition, the above method relates to an expansion agent fabrication method adapting a Thermit welding reaction used in an industrial field. In this case, a rock destruction work is possible under a negative pressure condition of rocks using a special stemming material. In addition, a certain object such as rocks is destructed based on a vaporization expansion method using a high temperature generating during a reaction of a metallic salt and a metallic powder. However, the above method is made without fully understanding a negative pressure generation condition and destruction condition (Fracture-ability class) of rocks, so that it is impossible to actually adapt the above method to an industrial field.

Generally, rocks have various kinds and sizes of non-continuities. Namely, there are non-continuities such as joint and cleavage and are further schistosity and bedding plane that occur at an initial step of formation of rocks. In addition, there are further non-continuities such as fault and fracture zone that are connected with a large scale of geology structure. Therefore, with the above features, rocks have mechanical heterogeneous and anisotropic structures. Therefore, in the case of the instant expansion metallic compound formed of a compound of a non-nitrate metallic salt and metallic powder, it can be very limitedly adapted with respect to intact rocks having homogeneous as well as isotropic structures. In the above method, the structural weak points of the rocks are removed by coating or filling the structural non-continuities in the interiors of the holes using a special material such as cement mortar, lime, and instant hardening agents as stemming materials for thereby maintaining a negative pressure condition, so that an effective rock destruction is achieved. The object with common rock conditions is not well destructed by the above method. Therefore, a certain special stemming material should be used in order to maintain a certain negative pressure condition (namely, sealed state). In addition, a certain hardening time is needed for thereby having an anti- pressure strength capable of satisfying the condition of negative pressure using a special stemming material. Therefore, a work time for destructing objects is increased, and a construction period is increased due to an inherent civil construction having a periodic work process, and a construction cost is increased. In a heavily jointed rock mass, even when a stemming material is used, it is impossible to maintain a negative pressure condition, so that a rock destruction effect is significantly decreased.

In the case of the above conventional art in which rocks are destructed using a vaporization expansion pressure using a non-nitrate metallic salt and metallic powder, it is needed to maintain a certain negative pressure condition (sealed state) in order to generate a ultra high pressure state. Therefore, a special stemming material such as cement mortar, instant hardening material, etc. is needed. In this case, even when a required negative pressure condition is met using a filling of stemming material, it is needed to maintain a high temperature for a vaporization expansion. Therefore, in this case, a high temperature heat is easily transferred to surrounding rocks, so that a loss of vaporization expansion pressure occurs, whereby a rock destruction effect is decreased.

SUMMARY OF THE INVENTION

Accordingly, it is an object of the present invention to provide an expansive cell composition for an electric rock destruction capable of overcoming the problems encountered in the conventional art.

It is another object of the present invention to provide an expansive cell composition for an electric rock destruction capable of decreasing a noise and vibration, preventing a change in quality, obtaining a negative pressure condition needed during a rock destruction of an expansion agent, significantly decreasing a fly of broken pieces of a destruction object after an object is destructed and reacted, and achieving an easier collection of broken pieces and a low noise and vibration during a reaction in such a manner that a compound of a hydrocarbon is mixed with a compound of a metallic salt and a metallic powder at an optimum stoichiometry composition ratio, and a hybrid-oxidation and combustion reaction is obtained, in which a hybrid-oxidation and combustion reaction is performed, in which a flame oxidation reaction of metallic salt and metallic powder and a combustion oxidation reaction of a hydrocarbon compound by the flame oxidation reaction are mixed.

To achieve the above objects, there is provided an expansive cell composition for an electric rock destruction, comprising a metallic powder selected from a metallic material that can be used as a reduction agent, comprising magnesium, steel, cooper, aluminum, and nickel; a metallic salt selected from sulfate, chromate, nitrate, nitrite and metallic compound used for oxidizing the metallic powder; and a hydrocarbon compound that is added as a combustion oxidation reaction material.

The metallic salt is 70~85 weight %, and said metallic powder is 5~10 weight %, and said hydrocarbon compound is 5~25 weight %.

DETAILED DESCRIPTION OF THE PREFERRED EMBODIMENTS

The preferred embodiments of the present invention will be described with reference to the accompanying drawings.

The expansive cell composition for an electric rock destruction according to the present invention is formed of a compound of a metallic salt that is a flame oxidation reaction material and a metallic powder, and a hydrocarbon compound powder that is a combustion oxidation reaction component.

The metallic salt is used for oxidizing the metallic powder. Sulfate, chromate, nitrate, nitrite, etc. can be used instead of the metallic salt. In addition, metallic oxidation material can be used for oxidizing the metallic power and at the same time adjusting the speed of oxidation reaction.

Here, the sulfate in the metallic salt is one or at least one selected from the group comprising $CuSO_4$, $BaSO_4$, and other metallic sulfate, and the chromate is one or at least one selected from the group comprising $(NH_4)_2Cr_2O_7$, $K_2Cr_2O_7$, etc, and the nitrate is one or at least one selected from the group $KNO_3$, $(Cu(NO_3)_2$, $NH_4NO_3$, $Ca(NO_3)^2$, $(Ba(NO_3)^2$ and other nitrate, and the nitrite is one or at least one selected from the group comprising $NaNO_2$ and $KNO_2$.

In addition, the metallic oxidation that is a kind of metallic salt is selected from the group comprising $CrO_3$, $KMnO_4$, $MnO_4$, $Pb_3O_4$, $Fe_3O_3$, CuO, and $TiO_2$. The metallic powder is formed of a unit metal or a compound that can be used as a reduction agent such as magnesium, steel, copper, aluminum, nickel, etc.

Here, the hydrocarbon compound is added as a combustion oxidation reaction material of metallic salt and metallic powder. Here, the hydrocarbon compound is $C_6H_{12}O_6$, $C_6H_{10}O_5$, $CO(NH_2)_2$, etc. that are structurally stable. The metallic salt and metallic powder and available powder are mixed, so that it is possible to maintain a reaction temperature of over 1200° C. At this time, the compound is mixed at an optimization of multi-component mixture ratio for thereby limitedly adjusting the generation amount of gases. At this time, in the mixture ratio, the metallic salt is 70~85 weight %, and the metallic powder is 5~10 weight %, and the hydrocarbon compound is 5~25 weight %.

In the above compound, the mixture ratio of the metallic salt is a ratio of oxygen amount discharged from metallic salt, oxygen amount needed to oxidation reaction of metallic powder, and stoichiometry needed to combustion oxidation reaction of hydrocarbon compound.

The method for fabricating an expansion cell composition for an electric rock destruction according to the present invention will be described.

One kind of metallic powder among multiple metallic powder and one kind of powder among hydrocarbon compound are well ground, or one or at least two kinds of metallic salts among metallic salts are well ground, or at least two kinds of metallic powders among multiple powders are mixed in a mixing container, and a mixture of the same is well ground using a grinding machine.

The well ground metallic salts and metallic powder, and hydrocarbon compound powder are mixed at a certain ratio by the amount needed for the energy of rock destruction.

The operation and effects of the expansive cell composition for an electric rock destruction according to the present invention will be described.

A user prepares an instant expansion metallic mixture according to the present invention at a construction site needing a rock destruction. A large size of current is fast discharged within 50~100 μd with respect to a metallic wire installed in the interior of an expansion agent spaced-apart by a safety distance (about 80 m) from a place in which the metallic compound is installed. At this time, a hybrid-oxidation and combustion reaction is generated by a high temperature heat and impact wave energy generated by a plasma channel of a metallic wire wherein a hybrid-oxidation and combustion reaction is performed, in which a flame oxidation reaction of metallic salt and metallic powder and a combustion oxidation reaction of a hydrocarbon compound by the flame oxidation reaction are mixed. At this time, a small amount of gases generated as the hydrocarbon compound is decomposed maintains a negative pressure condition in the rocks. At this time, the gases seal the gaps of the rocks and surround the outer side of the explosive compound according to the present invention, resulting in an outside shielding phenomenon. Therefore, it is possible to generate a vaporization expansion matching with a negative pressure needed for a reaction in the rocks and a fracture-ability class of the rocks without using a special stemming material for thereby destructing the rocks, resulting in many pieces of rocks.

In addition, the reaction products are fast changed into pieces, so that the objects do not fly after the rocks are destructed with low noise and vibrations.

The embodiments of the expansive cell composition for an electric rock destruction according to the present invention will be described. The present invention is not limited to the descriptions.

Embodiment 1

When mixing metallic salt, metallic powder and hydrocarbon compound, $CrO_3$ as metallic salt, Al as metallic powder, and $C_6H_{12}O_6$ as hydrocarbon compound were mixed for thereby fabricating an expansive cell composition for an electric rock destruction.

At this time, the oxidation chrome was added by 600 g for thereby occupying a ratio of 72% in weight % with respect to the mixture, and aluminum powder is added as metallic powder by 54 g (6.5 weight %), and $C_6H_{12}O_6$ is added by 180 g.

The above composition was filled in a cartridge and was tested using an electric detonator disclosed in the Korean patent application No. 2003-39474. At this time, flame was generated at the time when big current was applied to a detonation wire, and then a combustion reaction was checked.

The reaction of the expansive cell composition for an electric rock destruction according to a first embodiment of the present invention as follows.

$$6CrO_3+2Al+C_6H_{12}O_6 \rightarrow Cr_2O_3+4Cr+Al_2O_3+6CO_2+6H_2O$$

The amount of $CO_2$ generated in the above formula was 134.5 liter as a result of the measurement, and $H_2O$ was vaporized due to the effects of a high temperature and was in the phase of gas, and the amount of the same was 134.5 liter.

Embodiment 2

When mixing metallic salt, metallic powder and hydrocarbon carbon, $MnO_2$ as metallic salt, Mg as metallic powder, and $CO(NH_2)_2$ as hydrocarbon compound were mixed for thereby fabricating an expansive cell composition for an electric rock destruction.

At this time, $MnO_2$ was 348 g, Mg was 24 g, and $CO(NH_2)_2$ was 60 g, so that a metallic composition for rock destruction of 432 g was fabricated.

The expansive cell composition for an electric rock destruction fabricated according to the second embodiment of the present invention was explosion-tested in the same manner as the first embodiment, and then the reaction was as follows.

$$4MnO_2+Mg+CO(NH_2)_2 \rightarrow MgO+4MnO+CO_2+N_2+2H_2O$$

The amount of $CO_2$ and $N_2$ generated in the above formula was 22.4 liter as a result of the measurement, and $H_2O$ (vapor state) was 44.8 liter. Therefore, the generated gases sealed the gaps of the rocks and prevented a high temperature heat generated during explosion from being transferred to the rocks, so that a high temperature state was maintained.

As described in the above embodiments of the present invention, a hybrid-oxidation and combustion reaction was performed, wherein a combustion oxidation reaction of a hydrocarbon compound was mixed by a high temperature heat (2500° C.~35000° C.) generated in the metallic salt and with a flame oxidation reaction of metallic powder and a flame oxidation reaction. Therefore, it was possible to generate a solid expansion matching with a negative pressure needed to a reaction in the rocks and a fracture-ability class of the rocks without using a special stemming material, for thereby destructing rocks into many pieces.

Therefore, in the present invention, it is possible to effectively perform a rock destruction work without maintaining a special negative pressure condition by using a stemming material like in the conventional art.

As described above, in the expansive cell composition for an electric rock destruction according to the present invention, the composition is uniformly mixed at a certain composition ratio so that the composition is stably expanded by a high temperature heat and impact wave energy generated when a high current is fast discharged with respect to a metallic wire. A hybrid-oxidation and combustion reaction is performed, in which a flame oxidation reaction of metallic salt and metallic powder and a combustion oxidation reaction of a hydrocarbon compound by the flame oxidation reaction are mixed. Therefore, it is possible to generate a vaporization expansion force matching with a negative pressure needed to a reaction in the rocks and a fracture-ability class of the rocks without using a stemming material, thus destructing the rocks into many pieces and achieving the destructions of objects.

In addition, in the present invention, it is possible to easily obtain a negative pressure condition using a hydrocarbon compound and to prevent any change in quality that may occur during storage. Since the composition according to the present invention is chemically very stable, resulting in achieving a desired stability. In the present invention, it is easy to achieve a desired negative pressure condition needed for a rock destruction using an expansion agent using a small amount of gases generated during a combustion oxidation reaction of a hydrocarbon compound.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. An expansive cell composition for an electric rock destruction, comprising:

a metallic powder selected from a metallic material that can be used as a reduction agent, comprising magnesium, steel, copper, aluminum, and nickel;

a metallic salt powder selected from the group consisting of sulfate, chromate, nitrate, nitrite and metallic compound used for oxidizing the metallic powder; and a hydrocarbon compound powder that is added as a combustion oxidation reaction material, wherein said metallic salt powder is 70 - 85 weight %, and said metallic powder is 5 - 10 weight %, and said hydrocarbon compound powder is 5 - 25 weight %, and wherein when the metallic powder, the metallic salt powder and the hydrocarbon compound powder are mixed together and detonated, the resulting oxidation-combustion reaction maintains a reaction temperature over 1200° C.

2. An expansive cell composition for an electric rock destruction, comprising:

a metallic powder selected from a metallic material that can be used as a reduction agent, comprising magnesium, steel, copper, aluminum, and nickel;

a metallic salt powder selected from the group consisting of sulfate, chromate, nitrate, nitrite and metallic compound used for oxidizing the metallic powder; and a hydrocarbon compound powder that is added as a combustion oxidation reaction material, wherein said hydrocarbon powder is selected from the group consisting of $C_6H_{12}O_6$, $C_6H_{10}O_5$ and $CO(NH_2)_2$, and wherein when the metallic powder, the metallic salt powder and the hydrocarbon compound powder are mixed together and detonated, the resulting oxidation-combustion reaction maintains a reaction temperature over 1200° C.

3. The expansive cell composition for an electric rock destruction according to claim 1 wherein said hydrocarbon powder is selected from the group consisting of $C_6H_{12}O_6$, $C_6H_{10}O_5$ and $CO(NH_2)_2$.

4. The expansive cell composition for an electric rock destruction according to claim 1, wherein the sulfate is at least one selected from the group consisting of $CuSO_4$ and $BaSO_4$.

5. The expansive cell composition for an electric rock destruction according to claim 1, wherein the chromate is at least one selected from the group consisting of $(NH_4)_2Cr_2O_7$ and $K_2Cr_2O_7$.

6. The expansive cell composition for an electric rock destruction according to claim 1, wherein the nitrate is at least one selected from the group consisting of $KNO_3$, $Cu(NO_3)_2$, $NH_4NO_3$, $Ca(NO_3)_2$ and $Ba(NO_3)_2$.

7. The expansive cell composition for an electric rock destruction according to claim 1, wherein the nitrite is at least one selected from the group consisting of $NaNO_3$ and $KNO_2$.

8. The expansive cell composition for an electric rock destruction according to claim 1, wherein the metallic compound powder is at least one selected from the group consisting of $CrO_3$, $KMNO_4$, $MnO_4$, $Pb_3O_4$, $Fe_3O_3$, CuO and $TiO_2$.

9. The expansive cell composition for an electric rock destruction according to claim 2, wherein the sulfate is at least one selected from the group consisting of $CuSO_4$ and $BaSO_4$.

10. The expansive cell composition for an electric rock destruction according to claim 2, wherein the chromate is at least one selected from the group consisting of $(NH_4)_2Cr_2O_7$ and $K_2Cr_2O_7$.

11. The expansive cell composition for an electric rock destruction according to claim 2, wherein the nitrate is at least one selected from the group consisting of $KNO_3$, $Cu(NO_3)_2$, $NH_4NO_3$, $Ca(NO_3)_2$ and $Ba(NO_3)_2$.

12. The expansive cell composition for an electric rock destruction according to claim 2, wherein the nitrite is at least one selected from the group consisting of $NaNO_3$ and $KNO_2$.

13. The expansive cell composition for an electric rock destruction according to claim 1, wherein the metallic compound powder is at least one selected from the group consisting of $CrO_3$, $KMNO_4$, $MnO_4$, $Pb_3O_4$, $Fe_3O_3$, CuO and $TiO_2$.

14. An expansive cell composition for an electric rock destruction, comprising:

at least one metallic powder selected from the group consisting of steel, copper and nickel;

at least one metallic salt powder selected from the group consisting of sulfate, chromate, $KMNO_4$, $MnO_4$, $Pb_3O_4$, $Fe_3O_3$, CuO and $TiO_2$; and at least one hydrocarbon compound powder selected from the group consisting of $C_6H_{12}O_6$, $C_6H_{10}O_5$ and $CO(NH_2)_2$, wherein the at least one metallic salt powder is 70 - 85 weight %, and the at least one metallic powder is 5 - 10 weight %, and the at least one hydrocarbon compound powder is 5 - 25 weight %.

15. The expansive cell composition for an electric rock destruction according to claim 14, wherein the sulfate is at least one selected from the group consisting of $CuSO_4$ and $BaSO_4$.

16. The expansive cell composition for an electric rock destruction according to claim 15, wherein the chromate is at least one selected from the group consisting of $(NH_4)_2Cr_2O_7$ and $K_2Cr_2O_7$.

* * * * *